US005351949A

United States Patent [19]

Fox et al.

[11] Patent Number: 5,351,949

[45] Date of Patent: Oct. 4, 1994

[54] PUTTER-MOUNTED HOLDER FOR GOLF BALL POSITION MARKER

[76] Inventors: Robert B. Fox, 3810 Inwood Rd., #106, Dallas, Tex. 75209; Ronald B. Fox, 4831 Sugar Mill, Dallas, Tex. 75244

[21] Appl. No.: 166,091

[22] Filed: Dec. 13, 1993

[51] Int. Cl.[5] ..... A63B 53/14; A63B 57/00

[52] U.S. Cl. ..... 273/32 A; 273/162 D; 224/918

[58] Field of Search ..... 273/162 D, 32 A; 224/DIG. 918; 40/317

[56] References Cited

U.S. PATENT DOCUMENTS

| | | | |
|---|---|---|---|
| 1,756,141 | 4/1930 | Spellmeyer | 273/162 D X |
| 2,261,959 | 11/1941 | Buttikofer | 273/162 D |
| 2,700,547 | 1/1955 | Kraeling | 273/162 D |
| 4,957,293 | 9/1990 | Byrd | 273/162 D |

*Primary Examiner*—George J. Marlo
*Attorney, Agent, or Firm*—Ross, Howison, Clapp & Korn

[57] ABSTRACT

A putter handle grip end mounted holder designed to accept a wide range of commercial plastic golf ball position markers having dimensional differences, and adaptable to putter handle grips with different end contours and circumferential shapes. The holder is formed by a three-ply rubber and nylon laminate in a flat triangular configuration. The three corners have round, through holes which receive flat head screws. The screws both attach the holder to the putter grip end and provide a three point support to the underside of the circular ball marker top. A central round hole in the holder receives the elongated stem of a circular ball marker top. The ball marker stem is releasably held by the gripping action of the three-ply rubber and nylon construction.

8 Claims, 1 Drawing Sheet

PUTTER-MOUNTED HOLDER FOR GOLF BALL POSITION MARKER

TECHNICAL FIELD OF THE INVENTION

This invention relates to golf equipment, and more particularly to a putter-mountable holder for a golf ball position marker.

BACKGROUND OF THE INVENTION

It is a common practice to mark the position of a golf ball on the green with a coin or a plastic marker. Many golfers carry markers in their pocket or bag, although at times such items are forgotten. Even if one has either item in his pocket, it may still be necessary to sort one out from tees, keys or other pocket contents. As some golf slacks are fitted, getting items from one's pockets can be difficult. These difficulties have been appreciated in the prior art, which has proposed a variety of club-mounted holders for ball markers. Examples are U.S. Pat. Nos. 3,774,913; 3,779,559; 3,791,652; 3,977,674; 4,380,337; and 4,822052. None possess the versatility and ease of use which arises from the present invention. It can readily be applied to a variety of putters so that a ball marker is always available to the putting golfer on the green.

SUMMARY OF THE INVENTION

The invention described and claimed herein comprises a novel holding device for a commercially available plastic golf ball position marker. The holder is compatible with putter handle grips of different circumferential shapes and grip ends with varying contours. The holder has an equilateral triangular configuration with flat smooth top and bottom surfaces. The three corners have round through holes to receive flat head screws designed to both attach the holder to the putter grip end and to provide an adjustable three point solid support to the underside of the circular ball marker top.

The holder is formed from a three-ply laminate having top and bottom plies formed from a tough, yieldable resilient rubber with a nylon duck reinforced center ply. An alignment pin is provided for use during installation to a central ball marker stem hole in the holder with the air vent hole in the putter grip end. The alignment pin is a slender, elongated stem of metal with a point on one end and head on the other.

The marker comprises a flat circular disc with an integral elongated stem that extends downward from the center of the disc through the marker stem hole, into the air vent hole. The marker stem is releasably held by the three-ply construction with an interference fit giving a gripping action.

The holder is constructed for easy mounting in use. It easily and expeditiously receives, holds and releases a ball position marker. Ball markers are manufactured by different companies with no standard specifications. Consequently, available markers have varying dimensions. The holder of this invention can accommodate differences in the circular marker top diameter, thickness and design, as well as elongated marker stems of different diameters and lengths.

The holder body is an inexpensive one-piece stamping with round, perpendicular through punched holes all formed in the three-ply laminate in one operation, thus eliminating expensive tool and die work, machining, and assembly.

These and further objects, features and advantages will be more completely disclosed and described in the following drawings, specifications and the appended claims.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
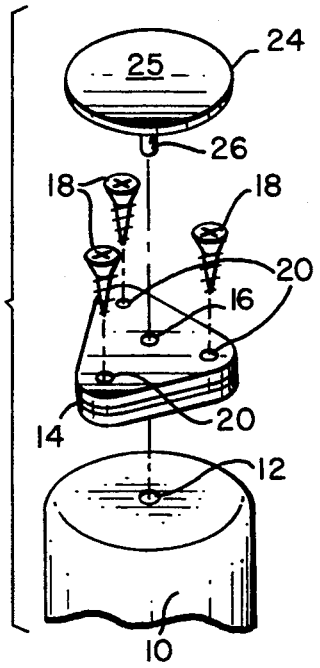
FIG. 1 is an exploded isometric view of a holder constructed in accordance with the invention with a putter handle grip and a golf ball position marker.
Figure 4:
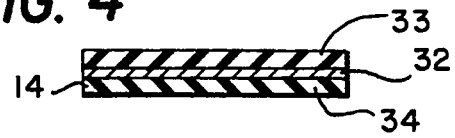
FIG. 4 is a sectional view of a three-ply rubber and nylon laminate from which the holder of this invention may be fabricated.

As shown in FIG. 1, a holder 14 constructed in accordance with this invention may be mounted on the end of a putter grip 10 having a conventional central air vent hole 12. Holder 14 comprises a flat gripping body in the shape of an equilateral triangle having vertices 23. Through holes 20 are formed through holder 14 near vertices 23. A central aperture 16 for receiving a ball marker is also formed through body 14. Holder 14 is mounted on the end of putter grip 10 and its central aperture 16 in alignment with air vent hole 12 by means of threaded flat head screws 18. Holder 14 may be formed by a die cutting step in which the holder 14 and all of the apertures 16 and 20 are formed in a single stamping operation. As shown in FIG. 4, the holder is fabricated from a three-ply material. The top ply 33 and bottom ply 34 are a resilient rubber such as neoprene. The central ply 32 is a nylon duck.

When mounted in position on putter grip 10, the holder may receive conventional ball marker 24 having an integral disc 25 and central stem 26. The central aperture 16 is of small enough diameter to be smaller than stem 26 of any marker with which it is to be used, so that by the interference fit and the three-ply construction, holder 14 produces a releasable gripping action on marker 24 when stem 26 is placed downwardly through aperture 16 and air vent hole 12. The thickness of holder 14 should be no greater than the shortest marker stem 26 which is to be used therewith.

Holder 14 is dimensioned so that the disc 25 of ball marker 24 will extend outwardly on all the three sides of holder 14. That is, an inscribed circle within the triangular shape defined by holder 14 will have a lesser diameter than the smallest disc 25 with which the holder is to be used. The cross-sectional views of FIG.

Figure 7:
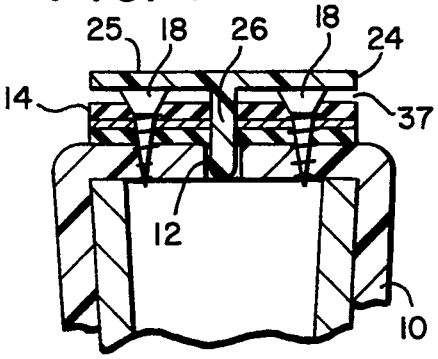
FIG. 7 is a sectional view in side elevation similar to FIG. 6 showing the golf ball position marker in place.

5 through FIG. 7 illustrate the mounting of the holder on the putter grip end.

Figure 5:
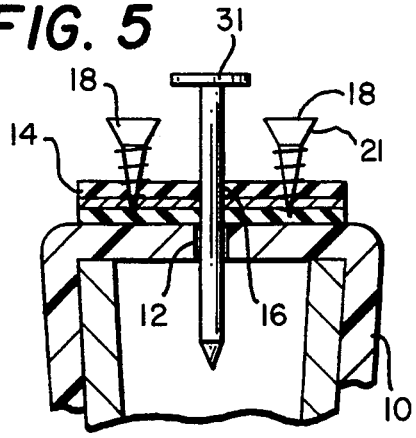
FIG. 5 is a sectional view in side elevation illustrating mounting of the holder with an alignment pin in place.
Figure 6:
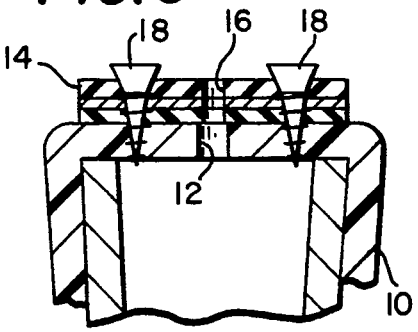
FIG. 6 is a sectional view in side elevation similar to FIG. 5, with the alignment pin removed.
Figure 8:
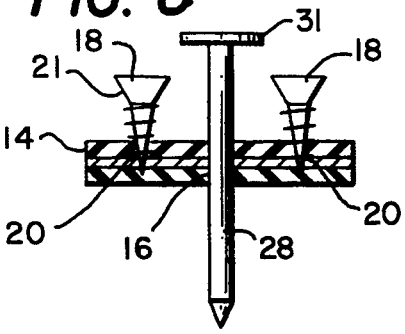
FIG. 8 is a side view illustrating the holder ready for installation on a putter.

As illustrated in FIG. 8, an alignment pin 31, which may be a common roofing nail, is placed through the central aperture 16. The flat head screws 18 are inserted part way into the through holes 20, which are of small enough diameter to be smaller than the threaded body of the screws, thereby releasably holding the screws. FIG. 5 shows the alignment pin 31 placed through the putter grip air vent hole 12. The holder 14 can be rotated to the position desired. The self tapping screws 18 can now be screwed into the end of the putter grip, not requiring pre-drilled holes. In tightening the screws, the top rubber ply will compress against the taper 21 of the screw heads. This allows the screws to form their own fitted conical depression, as the screws are tightened to the depth required to secure the holder 14 in place.

When the alignment pin 31 is removed, the device is ready to receive a ball marker as shown in FIG. 7. As seen in FIG. 7, the screws 14 provide a supporting surface for ball marker disc 25, which is spaced upwardly by gap 37 from the top of holder 14. This support, together with the fact that the disc extends outwardly around the edges of holder 14, makes it easy to grip disc 25 for removal and use of marker 24. The support provided by screws 14 for marker 24 helps to protect the marker from breaking when the putter is dropped into a golf bag, or in the event of any other impact on the putter end.

Figure 2:
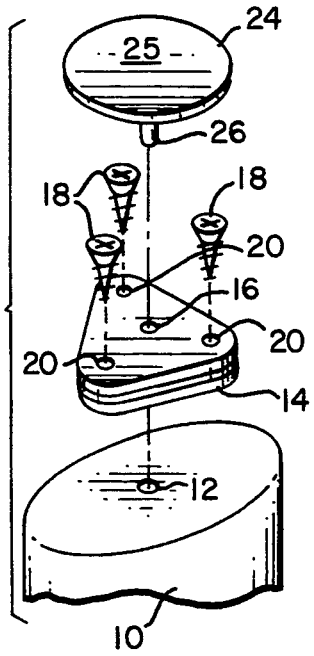
FIG. 2 is similar to FIG. 1, with the holder applied to a putter handle grip having contoured ends.
Figure 3:
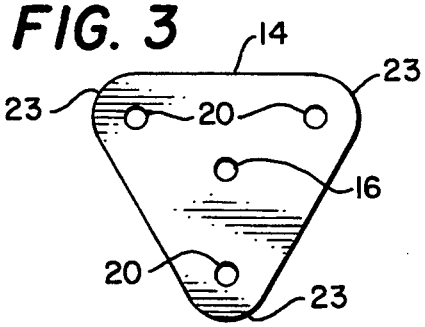
FIG. 3 is a plan view of the marker holder of FIGS. 1 and 2.

As illustrated in FIG. 2, the same holder can be applied to putter grip ends of varying configurations. FIG. 2 illustrates a putter grip having a contoured end rather than a flat end, with a circumference other than circular. Even with this variation, the holder constructed in accordance with the present invention may be readily installed as described above.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A holder for a golf ball position marker having a disc and integral stem, which holder comprises:

a flat gripping body formed from a rubber-nylon-rubber laminate and adapted to securement on the end of a putter handle grip, the body having a central aperture for gripping the marker stem, and having substantially the shape of an equilateral triangle.

2. The holder of claim 1 in combination with a ball marker having a disc and a stem, wherein the thickness of the body is less than the length of the ball marker stem, and the diameter of an inscribed circle just fitting inside the triangle defined by the body is less than the diameter of the ball marker disc.

3. The holder of claim 1, further comprising three flathead screws extending through the body adjacent the vertices thereof in combination with a putter grip end into which said screws are threaded to mount the holder thereto, whereby said screws are adapted to support the marker disc above the holder body.

4. The combination of claim 3 wherein the central aperture of the holder is aligned with an air vent hole on the putter grip end.

5. A holder for a golf ball position marker having a disc and integral stem, which holder comprises:

a flat resilient gripping body adapted to securement on the end of a putter handle grip, the body having a central aperture for gripping the marker stem, and having substantially the shape of an equilateral triangle, and being formed with three holes located near the vertices of the body.

6. The holder of claim 5 in combination with a ball marker having a disc and a stem, wherein the thickness of the body is less than the length of the ball marker stem, and the diameter of an inscribed circle just fitting inside the triangle defined by the body is less than the diameter of the ball marker disc.

7. The holder of claim 5, further comprising three flathead screws extending through the holes in the body adjacent the vertices thereof in combination with a putter grip end into which said screws are threaded to mount the holder thereto, whereby said screws are adapted to support the marker disc above the holder body.

8. The combination of claim 7 wherein the central aperture of the holder is aligned with an air vent hole on the putter grip end.

* * * * *